US012577861B2

(12) United States Patent
Li et al.

(10) Patent No.: US 12,577,861 B2
(45) Date of Patent: Mar. 17, 2026

(54) LIQUID ACCUMULATION-FREE PRODUCTION AND DRAINAGE SYSTEM FOR OIL AND GAS WELL

(71) Applicant: Shijiazhuang Zhidi Petroleum Engineering Technology Co., Ltd., Shijiazhuang (CN)

(72) Inventors: Jingzhi Li, Shijiazhuang (CN); Tianyu Zhang, Shijiazhuang (CN); Ziheng Cao, Shijiazhuang (CN); Yunshan Jin, Shijiazhuang (CN); Xudong Ding, Shijiazhuang (CN)

( * ) Notice: Subject to any disclaimer, the term of this patent is extended or adjusted under 35 U.S.C. 154(b) by 0 days.

(21) Appl. No.: 19/244,462

(22) Filed: Jun. 20, 2025

(65) Prior Publication Data

US 2025/0369321 A1 Dec. 4, 2025

Related U.S. Application Data

(63) Continuation of application No. PCT/CN2025/093784, filed on May 9, 2025.

(30) Foreign Application Priority Data

May 31, 2024 (CN) ..... 202410700471.7

(51) Int. Cl.
*E21B 43/12* (2006.01)
*E21B 43/38* (2006.01)

(52) U.S. Cl.
CPC ..... *E21B 43/123* (2013.01); *E21B 43/38* (2013.01)

(58) Field of Classification Search
CPC ..... E21B 43/38; E21B 43/123; E21B 43/122
See application file for complete search history.

(56) References Cited

U.S. PATENT DOCUMENTS

| | | | | |
|---|---|---|---|---|
| 1,846,435 A * | 2/1932 | Pendleton | E21B 43/123 417/142 |
| 5,806,599 A * | 9/1998 | Hisaw | E21B 33/12 166/372 |
| 5,857,519 A * | 1/1999 | Bowlin | E21B 43/123 166/372 |
| 6,382,321 B1 * | 5/2002 | Bates | E21B 43/124 417/172 |

(Continued)

FOREIGN PATENT DOCUMENTS

| | | |
|---|---|---|
| CN | 201013342 Y | 1/2008 |
| CN | 115405234 A | 11/2022 |
| CN | 116950616 A | 10/2023 |

*Primary Examiner* — David Carroll

(57) ABSTRACT

The present application relates to a liquid accumulation-free production and drainage system for oil and gas well, including a casing and a production string, and the casing is arranged in the oil and gas well, and the bottom of the casing is inserted below the oil and gas liquid level, the production string is arranged in the casing, so that an annular gap is formed between the casings and the production string. The production string is formed by connecting a plurality of oil and gas pipes, a plurality of anti-skid liquid accumulators and a plurality of anti-skid gas injectors end to end, one of the anti-skid liquid accumulators or one of the anti-skid gas injectors is arranged at intervals of several of the oil and gas pipes and and one of the anti-skid gas injectors is arranged at intervals of several of the anti-skid liquid accumulators.

6 Claims, 10 Drawing Sheets

(56) References Cited

U.S. PATENT DOCUMENTS

| | | | | |
|---|---|---|---|---|
| 2002/0040784 | A1* | 4/2002 | De Almeida | E21B 43/122<br>166/380 |
| 2005/0061369 | A1 | 3/2005 | De Almeida | |
| 2015/0053410 | A1* | 2/2015 | Arellano | E21B 43/38<br>166/309 |
| 2022/0120164 | A1* | 4/2022 | Miranda Tienda | E21B 43/10 |
| 2024/0254866 | A1* | 8/2024 | Lozano | E21B 34/06 |

* cited by examiner

LIQUID ACCUMULATION-FREE PRODUCTION AND DRAINAGE SYSTEM FOR OIL AND GAS WELL

CROSS-REFERENCE TO RELATED APPLICATIONS

This The present application is a continuation of International Application No. PCT/CN2025/093784, filed on May 9, 2025, which claims priority to Chinese Patent Application No. 202410700471.7, filed on May 31, 2024, the entire disclosure of both are incorporated herein by reference.

TECHNICAL FIELD

The present application relates to the field of oil and gas exploitation equipment, and in particular to a liquid accumulation-free production and drainage system for oil and gas well.

REARGROUND

Oil and gas well usually has a casing in the well, and a production string consisting of several oil and gas pipes (also called tubing in this industry) connected end to end is arranged in the casing. When in use, the gas-liquid mixture at the bottom of the oil and gas well is usually sprayed upward to the ground through the production string under the action of pressure difference, so as to realize oil and gas exploitation. However, in the process of oil and gas production, with the extension of production time, the formation pressure is gradually decreasing, and the water content of crude oil is gradually increasing, which leads to the decrease of the pressure difference between the liquid column and the formation, which makes the slippage of the liquid column more and more serious, and finally makes the oil and gas well stop flowing, which seriously affects the output of the oil and gas well.

In order to solve this problem, the commonly used methods at present are reducing the density of gas-liquid mixture by gas lift and bubble discharge, using electric submersible pump, lifting liquid column by plunger drainage, and increasing the flow rate of gas-liquid mixture by means of lower small tube column, but these methods have great limitations for natural gas exploitation; For example, gas lift technology is used to inject gas into the casing to reduce the liquid density. When natural gas is produced, the inside of the oil and gas well is mainly gas, and its pressure difference is very small, while the opening and closing of the gas lift valve is controlled by the pressure difference, which seriously affects the opening and closing of the gas lift valve. Therefore, gas lift technology is only suitable for crude oil production (the density of crude oil is high, and the pressure difference between the oil and gas well is large), but not for natural gas production. Secondly, The gas supply hole of gas lift valve is usually a straight hole, and the gas introduced into the oil and gas well can only reduce the density of gas-liquid mixture in the oil and gas well, but can not increase the flow rate of gas-liquid mixture, so its effect in avoiding slippage is also relatively general. In addition, one-way valves are installed in oil and gas well to prevent the liquid column from slipping, but this method occupies the central passage of the production string, making it impossible to install other downhole tools and detect various downhole parameters, such as temperature and pressure.

Therefore, how to improve the flow rate of gas-liquid mixture in oil and gas well and improve the gas carrying capacity of oil and gas well without occupying the central passage of production string is very important for improving the recovery rate of oil and gas well, especially the natural gas recovery rate of gas well.

SUMMARY

The purpose of the present disclosure is to overcome the defects in the prior art, and provide a liquid accumulation-free production and drainage system for oil and gas well, which improves the liquid carrying capacity of gas by using an anti-skid liquid accumulator, improves the gas-liquid mixture flow rate in a production string by using an anti-skid degassing hole structure, reduces the gas-liquid mixture density, and greatly improves the oil and gas recovery rate. It can be applied not only to oil well associated with oil and gas, but also to gas well associated with oil and gas, and has a wide application range.

To achieve the above purpose, the present application adopts the following technical solutions.

In a first aspect, the present application provides an anti-skid degassing hole structure, including an air supply channel arranged on the production string and used for communicating the inside and the outside of the production string, and a jet hole rotary block arranged in the air supply channel, wherein the center of the jet hole rotary block is provided with a jet hole A, and the jet hole A includes a short conical hole, a fine hole and a long conical hole sequentially arranged and communicated according to a gas flow direction, and a taper of the short conical hole is greater than a taper of the long conical hole.

The present technical scheme is further set as follows, a limit boss is arranged in the air supply channel, and a steel pad and an annular gasket are arranged between the limit boss and the jet hole rotary block.

The present technical scheme is further set as follows, the air supply channel is obliquely arranged in a vertical direction, and a distance between an upper end of the air supply channel and the central axis of the production string is smaller than a distance between a bottom end of the air supply channel and the central axis of the production string.

The present technical scheme is further set as follows, the air supply channel is eccentrically arranged with the central axis of the production string as the center in the horizontal direction.

In a second aspect, the present application provides a liquid accumulation-free production and drainage system for oil and gas well, including a casing, wherein the casing is arranged in the oil and gas well, and the bottom of the casing is inserted below the oil and gas liquid level; and a production string, wherein the production string is arranged in the casing, so that an annular gap is formed between the casing and the production string, wherein the production string is formed by connecting a plurality of oil and gas pipes, a plurality of anti-skid liquid accumulators and a plurality of anti-skid gas injectors end to end; one of the plurality of anti-skid liquid or one of the plurality of anti-skid gas injectors is arranged at intervals of several of the plurality of oil and gas pipes, and one of the plurality of anti-skid gas injectors is arranged at intervals of several of the plurality of anti-skid liquid accumulators, and in the lower part of the production string, the number of the plurality of anti-skid liquid accumulators between adjacent anti-skid gas injectors is smaller.

The present technical scheme is further set as follows, one of the the plurality of anti-skid gas injectors comprises an oil and gas pipe joint and an anti-skid degassing hole structure on the oil and gas pipe joint.

The present technical scheme is further set as follows, one of the plurality of anti-skid liquid accumulators comprises a pipe body, a main gas channel arranged in the center of the pipe body, an annular groove arranged on an inner wall of the pipe body and communicated with the main gas channel, a gas branch channel arranged in the annular groove and an annular liquid receiving groove with an upward opening, wherein the gas branch channel passes through the annular liquid receiving groove.

The present technical scheme is further set as follows, a top wall of the annular groove is provided with an annular deflector, an inner wall of the annular deflector is smoothly connected with an inner wall of the upper part of the pipe body, and a lower part of the annular deflector is inserted into the annular liquid receiving groove, to form a bending passage in the annular liquid receiving groove.

The present technical scheme is further set as follows, an annular cylinder is arranged on the inner wall of the pipe body, and the annular cylinder and the inner wall of the pipe body form an annular cavity, the main gas channel is arranged in the center of the annular cylinder, the annular liquid receiving groove is arranged on the annular cylinder, and the annular cylinder is provided with a plurality of gas inlets communicating the main gas channel with the annular cavity.

The present technical scheme is further set as follows, the annular cylinder is connected with the top wall of the annular groove in a gap, to form a first channel communicating with the annular cavity and the bending passage and an annular gas outlet communicating with the bending passage and the main gas channel.

The present technical scheme is further set as follows, the plurality of gas inlets, the annular cavity, the first channel, the bending channel and the annular gas outlet are sequentially communicated to form the gas branch channel.

The present technical scheme is further set as follows, the annular cylinder includes an annular base arranged on the inner wall of the pipe body, and the annular liquid receiving groove is arranged on the annular base.

The present technical scheme is further set as follows, the plurality of gas inlets are arranged on the annular base, and the position of the plurality of air inlets are higher than the lowest point of the annular cavity.

The present technical scheme is further set as follows, the annular liquid receiving groove is formed by enclosing an inner ring plate and an outer ring plate, and an upper surface of the inner ring plate is lower than an upper surface of the outer ring plate.

The present technical scheme is further set as follows, when the anti skid degrassing hole structure is arranged on the pipe body of one of the anti-slip liquid accumulators, two ends of the air supply channel are respectively communicated with the annular gap and the main gas channel or the gas branch channel.

The present technical scheme is further set as follows, the oil and gas pipe joint comprises a joint pipe body, a central gas channel arranged on the joint pipe body, a external thread and an internal thread respectively arranged at two ends of the joint pipe body.

The present technical scheme is further set as follows, the anti-skid degassing hole structure is arranged on the joint pipe body, and two ends of the air supply channel of the anti-skid degassing hole structure are respectively communicated with the annular gap and the central gas channel.

The present technical scheme is further set as follows, a bottom of the casing is provided with a perforation section communicating with an oil-gas layer and an inside of the casing, and a bottom of the production string is provided with a sieve tube, a part of the the production pipe string extends out of the ground is provided with a Christmas tree, and the annular gap is provided with an air charging port, and the air charging port is communicated with a high-pressure air source through an air injection pipeline.

The application of liquid accumulation-free production and drainage system for oil and gas well in oil or gas wells accompanied by gas and liquid.

The present technical scheme is further set as follows, the gas well includes any one of a natural gas well, a shale gas well and a gas lift production gas well, the oil well includes any one of a gas lift oil well, an electric submersible pump oil well and a screw pump oil well.

Beneficial Effects of the Present Application:

1. According to the present disclosure, a jet hole rotary block is arranged in the gas supply channel communicating the inside and the outside of the production string, and when gas passes through the jet hole rotary block, a Laval effect can be formed, so that the gas flow entering the gas supply channel is accelerated and sprayed to the inside of the production string at high speed, so that a negative pressure zone is formed near the jet hole A of the production string, and the flow rate of the gas-liquid mixture in the production string is improved.
2. According to the present disclosure, the air supply channel communicating the inside of the production string and the annular space is eccentrically arranged, so that the gas can spirally move upward when being injected into the production string, and compared with the vertical upward movement in the prior art, the Bernoulli principle of the supplied gas can be used to form a supporting force for the original gas-liquid mixture in the production string, thereby further preventing the gas from slipping off.
3. When natural gas rises in the production string, the gas-liquid mixture will be rubbed by the inner wall of the production string, and the speed will gradually decrease. The frictional resistance of the production string is transferred from the periphery of the tube to the center of the tube by the viscosity of the gas-liquid mixture. Therefore, the gas-liquid mixture velocity decreases quickly near the inner wall of the production string, while the gas-liquid mixture velocity decreases slowly in the center of the production string, which makes the liquid fall down along the inner wall of the tube, resulting in flooding of the gas well. In order to solve this problem, an anti-skid liquid accumulator is added every certain distance. The inner wall of the pipe body is provided with a liquid receiving groove and a guide plate, and the inner wall of the pipe body is provided with a gas branch channel passing through the liquid receiving groove. The guide plate guides the liquid falling along the pipe wall to the liquid receiving groove to prevent it from slipping to the bottom of the well. In the process of oil and gas rising along the central gas channel, part of the gas is diverted by the gas branch channel to take out the liquid in the liquid receiving groove when it passes through the liquid receiving groove. In addition, when the natural gas is sprayed from the gas branch pipeline, the upward airflow can also form an upward supporting force for the liquid on the pipe wall, which can further block the sliding of the liquid on the pipe wall. To sum up, the liquid carrying capacity of natural gas is greatly improved by using the annular liquid receiving tank, the guide plate and the branch gas channel in cooperation, and the problem of gas well flooding caused by liquid sliding is avoided. Compared with the gas lift technology of oil and gas wells, the liquid carrying capacity of natural gas can be improved without additional energy supply, and the liquid lifting technology has wider applicability and lower cost.

To sum up, on the one hand, the anti-skid degassing hole structure is improved to improve the flow speed of gas-liquid mixture in the production string, and on the other hand, an anti-skid liquid accumulator is added to the production string, which can make full use of the pay zone pressure to improve the gas carrying capacity of oil and gas wells without occupying the central channel of the production string, so as to achieve the effect of avoiding liquid accumulation and improve the oil and gas recovery. The disclosure can be applied not only to oil wells, but also to gas wells, and solves the problems of liquid slippage in the production process of oil and gas wells, water flooding of gas wells and low natural gas recovery due to the decrease of liquid carrying capacity of gas wells.

DETAILED DESCRIPTION OF THE EMBODIMENTS

Figure 1:
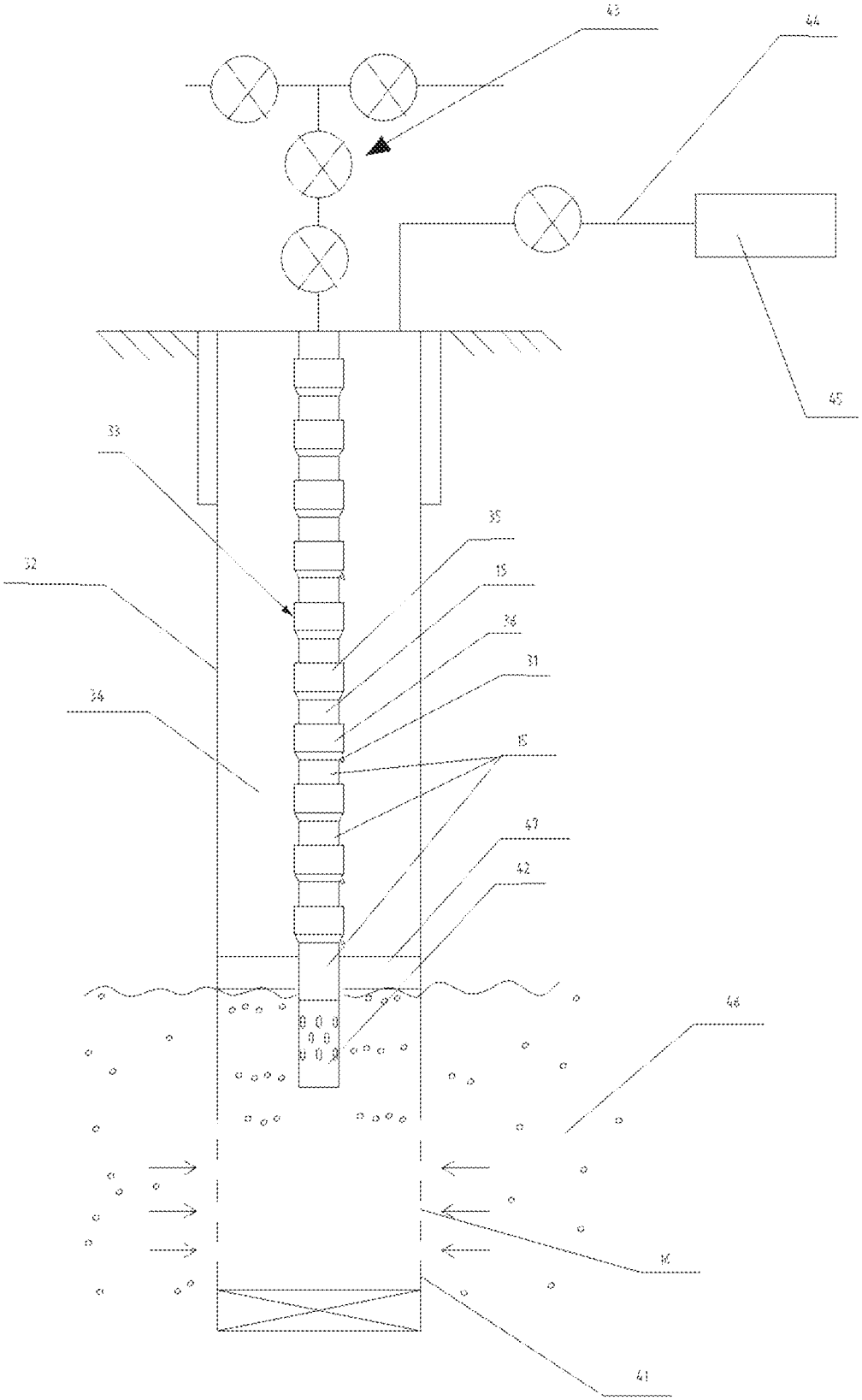
FIG. 1 is a structural schematic diagram of an embodiment of the present application.
Figure 2:
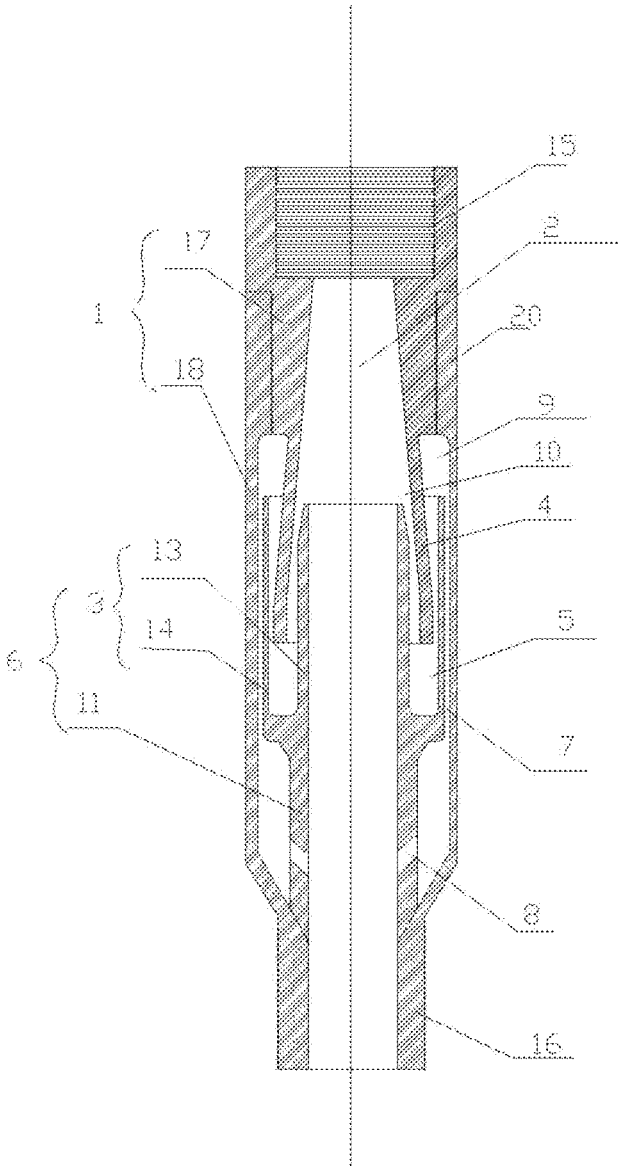
FIG. 2 is a structural schematic diagram of a valve body A according to an embodiment of the present application.
Figure 3:
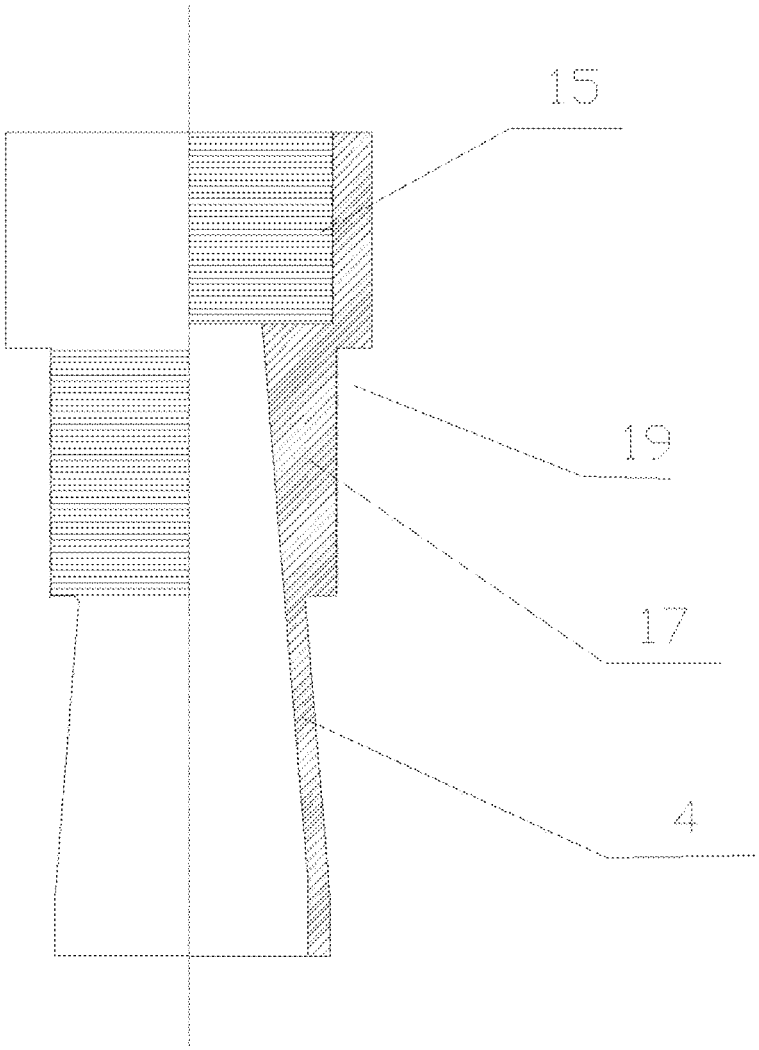
FIG. 3 is a structural schematic diagram of an upper pipe body according to an embodiment of the present application.
Figure 4:
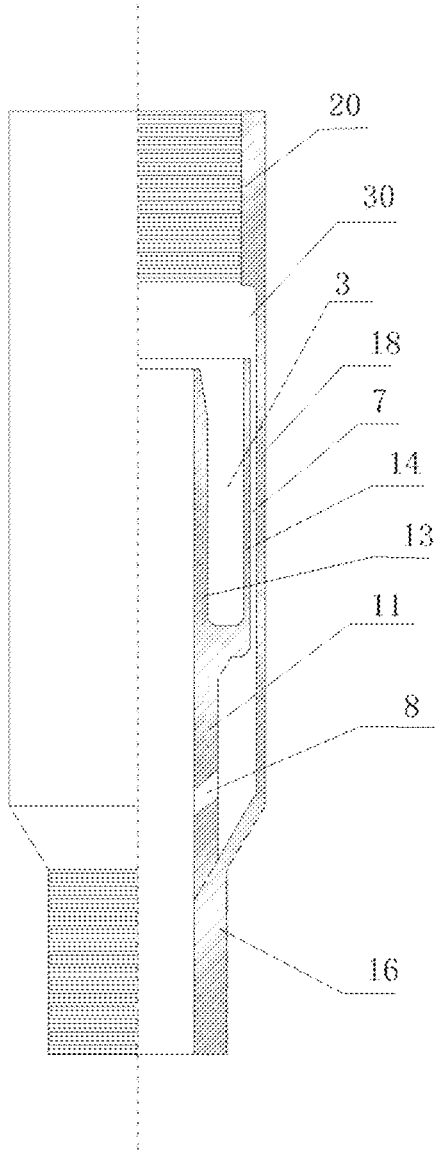
FIG. 4 is a a structural schematic diagram of an lower pipe body according to an embodiment of the present application.
Figure 5:
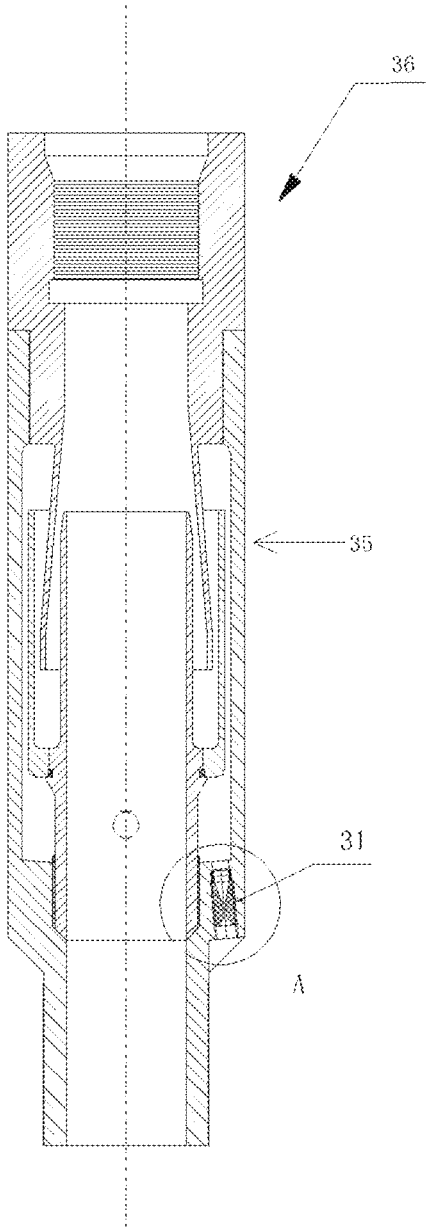
FIG. 5 is a structural schematic diagram of a valve body B according to an embodiment of the present application.
Figure 6:
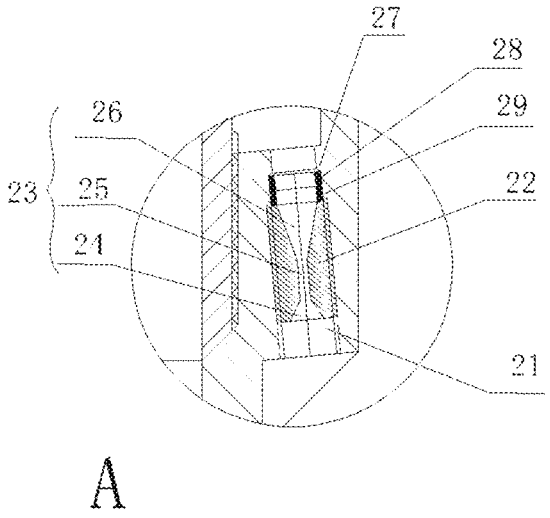
FIG. 6 is is an enlarged view at A of FIG. 5.
Figure 7:
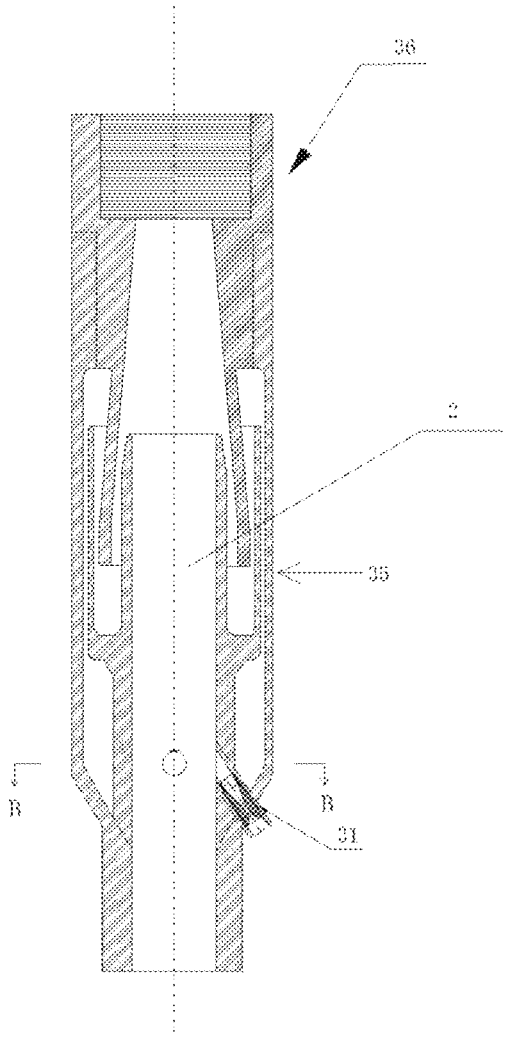
FIG. 7 is a structural schematic diagram of a valve body B according to other embodiment of the present application.
Figure 8:
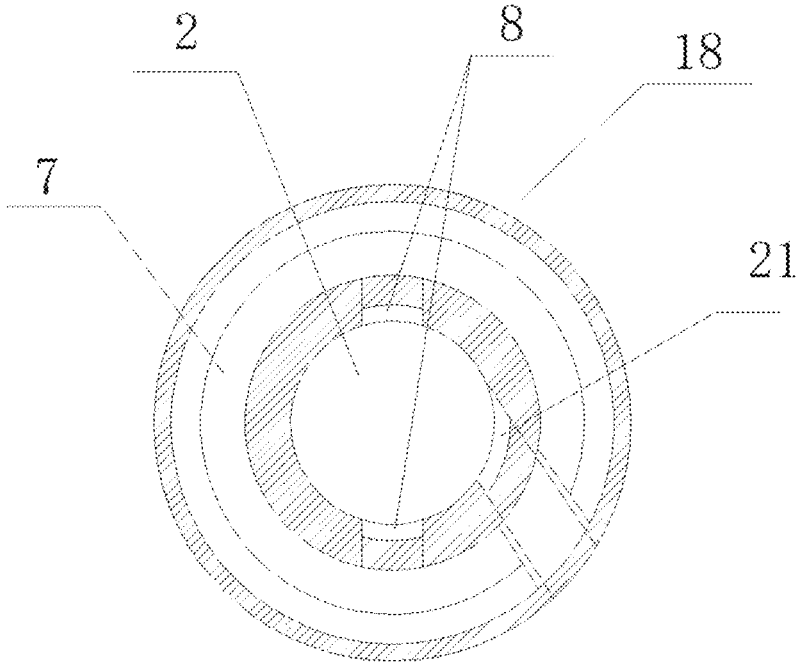
FIG. 8 is a sectional view taken along the line B-B in FIG. 7.

The technical scheme of the present disclosure will be described clearly and completely with the attached drawings. Obviously, the described embodiments are part of the embodiments of the present disclosure, but not all of them. Based on the embodiments in this disclosure, all other embodiments obtained by ordinary technicians in this field without creative work belong to the scope of protection in this disclosure.

In the description of this disclosure, it should be noted that the azimuth or positional relationship indicated by the terms "center", "upper", "lower", "left", "right", "vertical", "horizontal", "inner" and "outer" are based on the azimuth or positional relationship shown in the attached drawings, and are only for the convenience of describing this disclosure and simplifying the description, and are not indicated or implied. In addition, the terms "first", "second" and "third" are only used for descriptive purposes and cannot be understood as indicating or implying relative importance.

In the description of this disclosure, it should be noted that unless otherwise specified and limited, the terms "installation", "connection" and "connection" should be broadly understood, for example, they can be fixed connection, detachable connection or integrated connection; It can be a mechanical connection or an electrical connection and can be directly connected, can also be indirectly connected through an intermediate medium, and can be connected inside two elements. For those skilled in the art, the specific meanings of the above-mentioned technical words in this disclosure can be understood in specific situations.

In this disclosure, the explanation of the term "liquid accumulation-free": slippage refers to the phenomenon that gas exceeds liquid flow due to the density difference between gas and liquid in gas-liquid two-phase pipe flow. Because of slippage, the gas phase in the wellbore of oil and gas well is not enough to carry the liquid phase, which leads to the liquid phase falling back to the bottom of the well and accumulating step by step, forming liquid accumulation; Free from liquid accumulation is to prevent the formation of liquid accumulation and avoid the production of oil and gas well from being affected by liquid accumulation in production string, which is called liquid accumulation-free.

The present disclosure will be described in further detail with reference to the drawings.

Embodiment 1

According to an embodiment of the present application, a liquid accumulation-free production and drainage system for oil and gas well is provided, referring to FIGS. 1 to 8, including a casing 32, wherein the casing 32 is arranged in the oil and gas well, and the bottom of the casing 32 is inserted below the oil and gas liquid level; and a production string 33, wherein the production string 33 is arranged in the casing 32, so that an annular gap is formed between the casing 32 and the production string 33, wherein the production string 33 is formed by connecting a plurality of oil and gas pipes 15, a plurality of anti-skid liquid accumulators 35 and a plurality of anti-skid gas injectors 36 end to end; one of the plurality of anti-skid liquid accumulators 35 or one of the plurality of anti-skid gas injectors 36 is arranged at intervals of several of the plurality of oil and gas pipes 15, and one of the plurality of anti-skid gas injectors 36 is arranged at intervals of several of the plurality of anti-skid liquid accumulators 35, and in the lower part of the production string 33, the number of the plurality of anti-skid liquid accumulators 35 between adjacent anti-skid gas injectors 36 is smaller.

One of the plurality of anti-skid liquid accumulators 35 includes a pipe body 1, a main gas channel 2 arranged in the center of the pipe body 1, an annular groove 30 arranged on an inner wall of the pipe body 1 and communicated with the main gas channel, a gas branch channel arranged in the annular groove 30 and an annular liquid receiving groove 3 with an upward opening, wherein the gas branch channel passes through the annular liquid receiving groove.

One of the the plurality of anti-skid gas injectors 36 includes an ant-skid liquid accumulator 35 and an anti-skid degassing hole structure 31 arranged on the anti-skid liquid accumulator 35.

The anti-skid degassing hole structure includes an air supply channel 21 arranged on the production string 33 and used for communicating the inside and the outside of the production string 33, and a jet hole rotary block 22 arranged in the air supply channel 21, wherein the center of the jet hole rotary block 22 is provided with a jet hole A 23, and the jet hole A 23 comprises a short conical hole 24, a fine hole 25 and a long conical hole 26 sequentially arranged and communicated according to a gas flow direction, and a taper of the short conical hole 24 is greater than a taper of the long conical hole 26.

The anti-skid degassing hole 31 structure is arranged on the pipe body 1 of one of the anti-slip liquid accumulators 35, two ends of the air supply channel 21 are respectively communicated with the annular gap 34 and the main gas channel 2 or the gas branch channel.

As an embodiment of a liquid accumulation-free production and drainage system for oil and gas well of the present disclosure, a limit boss 27 is arranged in the air supply channel 21, and a steel pad 28 and an annular gasket 29 are arranged between the limit boss 27 and the jet hole rotary block 22.

As an embodiment of a liquid accumulation-free production and drainage system for oil and gas well of the present disclosure, the air supply channel 21 is obliquely arranged in a vertical direction, and a distance between an upper end of the air supply channel 21 and the central axis of the production string 33 is smaller than a distance between a bottom end of the air supply channel and the central axis of the production string 33.

As an embodiment of a liquid accumulation-free production and drainage system for oil and gas well of the present disclosure, the air supply channel 21 is eccentrically arranged with the central axis of the production string 33 as the center in the horizontal direction.

As an embodiment of a liquid accumulation-free production and drainage system for oil and gas well of the present disclosure, a top wall of the annular groove 30 is provided with an annular deflector 4, an inner wall of the annular deflector 4 is smoothly connected with an inner wall of the upper part of the pipe body 1, and a lower part of the annular deflector 4) is inserted into the annular liquid receiving groove 3, to form a bending passage 5 in the annular liquid receiving groove 3.

As an embodiment of a liquid accumulation-free production and drainage system for oil and gas well of the present disclosure, an annular cylinder 6 is arranged on the inner wall of the pipe body 1, and the annular cylinder 6 and the inner wall of the pipe body form an annular cavity 7, the main gas channel is arranged in the center of the annular cylinder 6, the annular liquid receiving groove 3 is arranged on the annular cylinder 6, and the annular cylinder 6 is provided with a plurality of gas inlets 8 communicating the main gas channel with the annular cavity 7.

As an embodiment of a liquid accumulation-free production and drainage system for oil and gas well of the present disclosure, each of the air inlets 8 is obliquely arranged, and the inlet end of each of the air inlets 8 is low and the outlet end of each of the air inlets 8 is high.

As an embodiment of a liquid accumulation-free production and drainage system for oil and gas well of the present disclosure, the annular cylinder 6 is connected with the top wall of the annular groove 30 in a gap, to form a first channel 9 communicating with the annular cavity 7 and the bending passage 5 and an annular gas outlet 10 communicating with the bending passage 5 and the main gas channel.

As an embodiment of a liquid accumulation-free production and drainage system for oil and gas well of the present disclosure, the plurality of gas inlets 8, the annular cavity 7, the first channel 9, the bending channel 5 and the annular gas outlet 10 are sequentially communicated to form the gas branch channel.

As an embodiment of a liquid accumulation-free production and drainage system for oil and gas well of the present disclosure, the annular cylinder 6 comprises an annular base arranged on the inner wall of the pipe body 1, and the annular liquid receiving groove is arranged on the annular base.

As an embodiment of a liquid accumulation-free production and drainage system for oil and gas well of the present disclosure, the air inlets 8 are arranged on the annular base, and the position of the air inlets 8 are higher than the lowest point of the annular cavity 7.

As an embodiment of a liquid accumulation-free production and drainage system for oil and gas well of the present disclosure, the annular liquid receiving groove 3 is enclosed by an inner ring plate 13 and an outer ring plate 14, and the upper surface of the inner ring plate 13 is lower than that of the outer ring plate 14.

As an embodiment of a liquid accumulation-free production and drainage system for oil and gas well of the present disclosure, the pipe body 1 includes an upper tube body 17 and a lower tube body 18, wherein the outer wall of the upper tube body 17 is provided with an annular groove 19, and the bottom of the lower tube body 18 is provided with an annular tube 20 adapted to the annular groove 19, and the annular tube 20 is arranged in the annular groove 19 and connected with the annular groove 19 in a threaded manner. In addition, as another embodiment, the annular tube 20 and the annular groove 19 can also be fixed by bonding, welding.

As an embodiment of a liquid accumulation-free production and drainage system for oil and gas well of the present disclosure, a bottom of the casing 32 is provided with a perforation section 41 communicating with an oil-gas layer 46 and an inside of the casing 32, and a bottom of the production string 33 is provided with a sieve tube 42, a part of the the production pipe string 33 extends out of the ground is provided with a Christmas tree 43, and the annular gap 34 is provided with an air charging port, and the air charging port is communicated with a high-pressure air source 45 through an air injection pipeline 44.

The perforation section 41 is provided with a plurality of jet holes B16 communicating with the oil-gas layer 46 and the inside of the casing 32.

Embodiment 2

Figure 9:
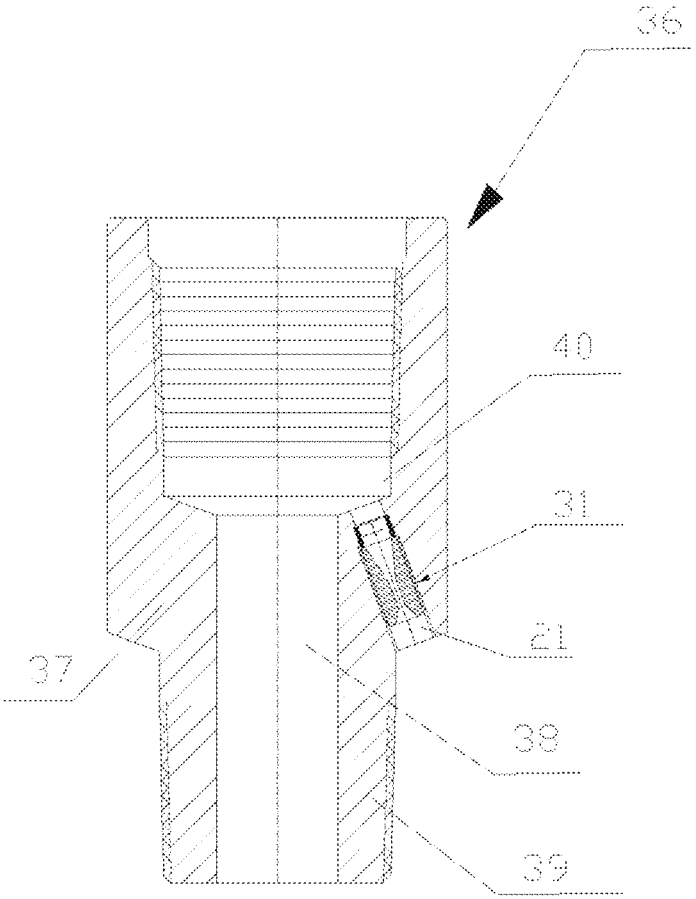
FIG. 9 is a structural schematic diagram of a valve body B according to another embodiment of the present application.

Embodiment 2 is partially the same as Embodiment 1, except that the structure of the anti-skid gas injector 36 is different. In Embodiment 2, as shown in FIG. 9, the anti-skid gas injectors 36 comprises an oil and gas pipe joint 15 and an anti-skid degassing hole structure on the oil and gas pipe joint.

The anti-skid degassing hole structure includes an air supply channel 21 arranged on the production string 33 and used for communicating the inside and the outside of the production string 33, and a jet hole rotary block 22 arranged in the air supply channel 21, wherein the center of the jet hole rotary block 22 is provided with a jet hole A 23, and the jet hole A 23 comprises a short conical hole 24, a fine hole 25 and a long conical hole 26 sequentially arranged and communicated according to a gas flow direction, and a taper of the short conical hole 24 is greater than a taper of the long conical hole 26.

The oil and gas pipe joint comprises a joint pipe body 37, a central gas channel 38 arranged on the joint pipe body 37, a external thread 39 and an internal thread 40 respectively arranged at two ends of the joint pipe body 37.

The anti-skid degassing hole structure is arranged on the joint pipe body 37, and two ends of the air supply channel 21 of the anti-skid degassing hole structure are respectively communicated with the annular gap 34 and the central gas channel 38.

As an embodiment of a liquid accumulation-free production and drainage system for oil and gas well of the present disclosure, a limit boss 27 is arranged in the air supply channel 21, and a steel pad 28 and an annular gasket 29 are arranged between the limit boss 27 and the jet hole rotary block 22.

As an embodiment of a liquid accumulation-free production and drainage system for oil and gas well of the present disclosure, the air supply channel 21 is obliquely arranged in a vertical direction, and a distance between an upper end of the air supply channel 21 and the central axis of the production string 33 is smaller than a distance between a bottom end of the air supply channel and the central axis of the production string 33.

As an embodiment of a liquid accumulation-free production and drainage system for oil and gas well of the present disclosure, the air supply channel 21 is eccentrically arranged with the central axis of the production string 33 as the center in the horizontal direction.

Embodiment 3

The liquid accumulation-free production and drainage system for oil and gas well described in Embodiment 1 or Embodiment 2 can be applied to oil wells or gas wells with gas and liquid.

As an example of the application described in the present disclosure, the gas wells include natural gas wells, shale gas wells, gas lift production gas wells, and the like.

As an example of the application described in this disclosure, the oil wells include gas lift oil wells, electric submersible pump oil wells, screw pump oil wells, and the like.

As an example of the application described in the present disclosure, in the case that the original well production cannot be pulled out, the pipe-in-pipe mode can be adopted, a production string of the present disclosure is run in the original well production string. The use method and principle of the present disclosure:

When oil and gas wells are exploited, the gas-liquid mixture in the main gas channel 2 on the production string 33 is ejected upward along the production string 33 under the action of pressure difference. With the extension of oil and gas exploitation time, the pressure difference decreases, and the gas-liquid mixture velocity in the inner wall area of the production string 33 decreases faster than that in the central area under the action of the friction force of the inner wall of the production string 33, which causes the liquid in the inner wall of the production string 33 to slide down along the pipe wall. When it slides down to the anti-skid liquid accumulator 35, it will drop into the annular liquid receiving groove 3 along the annular deflector 4, and when the gas-liquid mixture running upward along the main gas pipeline passes through the gas inlet 8, part of the gas will enter the gas branch channel, and when the gas runs along the gas branch channel, it will blow out the liquid received in the annular liquid receiving groove 3 and carry it into the main gas channel 2 again, thus avoiding the liquid from sliding down at the pipe wall and improving the liquid carrying capacity. In addition, the gas-liquid mixture will be blown out and carried into the main gas channel 2 again. When the gas in the gas branch channel is blown out, it also forms a supporting force for the liquid at the pipe wall, and blocks the channel where the liquid on the inner wall of the production string 33 slides downward, thus preventing the liquid from falling continuously.

In addition, when oil and gas wells with low pressure and output are exploited, high-pressure gas can also be introduced into the annular gap 34. When the high-pressure gas enters the production string 33 through the anti-skid gas injector 36, the arrangement of the jet hole A23 on the anti-skid degassing hole structure can accelerate the gas and improve the flow speed of the gas-liquid mixture in the production string 33, thus avoiding its slippage. In addition, when the gas supply channel 21 is eccentrically arranged, the gas entering the production string 33 from the annular gap 34 will spiral upward, forming a supporting force for the gas-liquid mixture in the production string 33, further avoiding its slippage.

To sum up, on the one hand, this disclosure improves the structure of the anti-skid blowhole so that it can increase the flow speed of the gas-liquid mixture in the production string 33, and on the other hand, it adds an anti-skid liquid accumulator 35 to the production string 33, which can reduce the slippage of liquid, improve the gas carrying capacity of oil and gas wells, make full use of the pay zone pressure and improve the oil and gas recovery rate without occupying the central passage of the production string 33. This disclosure can not only be applied to oil wells, It can also be used in gas wells to solve the problems of liquid slippage in the production process of oil and gas wells, water flooding of gas wells and low natural gas recovery due to the decrease of liquid carrying capacity of gas wells.

Figure 10:
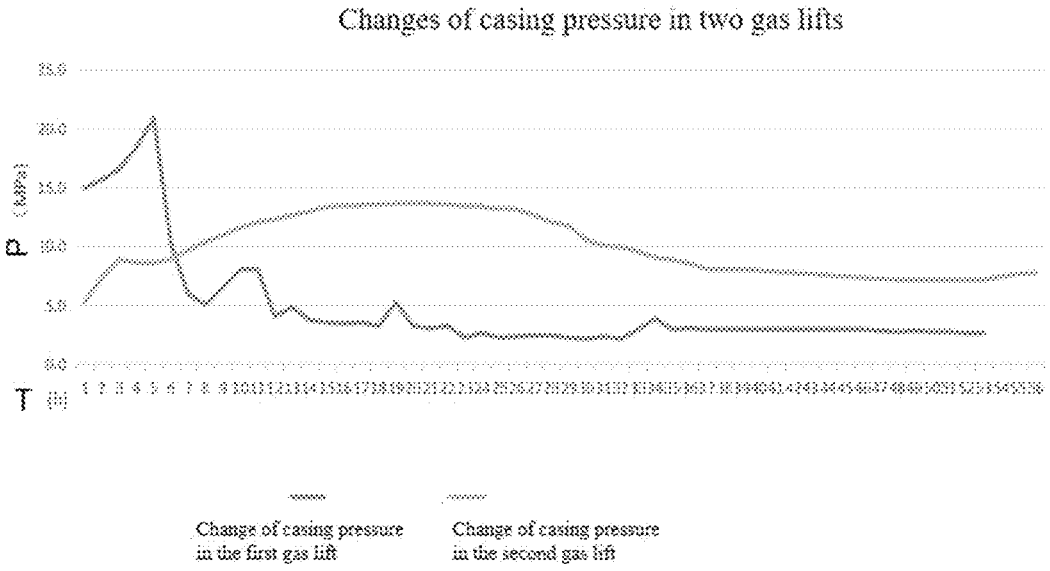
FIG. 10 is a schematic diagram of a comparison diagram of the first gas lift induced injection and the first gas lift induced injection according to an embodiment of the present application.

Effect embodiment: the application embodiment of Su X-X-XXH natural gas flowing well Because the contents of each operation section are different before and after construction, and the time used is quite different, it is impossible to compare and analyze the change of drainage one by one. Therefore, in the induced injection stage of natural gas flowing wells, the gas-lift drainage change and hourly drainage volume of traditional gas-lift induced injection and gas-lift induced injection in this disclosure are compared (FIG. 10), and after well handover, the gas production data when stable production is adopted by this disclosure are recorded (FIG. 11), and the results are as follows.

1. The first gas-lift induced injection (traditional gas-lift induced injection before running the production string of the application): open for 3 hours before gas-lift, 4 hours after gas-lift, and open for 46 hours after stopping gas-lift, for a total of 53 hours, with the highest casing pressure of 20.8 MPa and the lowest pressure of 2.1 MPa, and the cumulative liquid output of 61.5 m, with the highest liquid output of 8.4 m per hour and the average liquid output of about 1.16 m per hour.
2. The second gas-lift induced injection (using the production string of the present application): after replacing the production string 33 in the traditional gas-lift technology with the production string 33 of the present invention, that is, the technology of the present application, the gas-lift is carried out for 26 hours, and then the well is shut in for 29 hours, for a total of 55 hours, and the cumulative liquid output is 129.8 m, with the highest liquid output of 8.1 m per hour and the average liquid output of about 2.36 m per hour.

As can be Seen from the Above Results:

1. After the gas lift well is reformed according to this disclosure, the average liquid output per hour of gas lift is still more than 2 times of the average liquid output per hour before the reform, even if the time used for gas lift before the reform is exceeded.
2. In the traditional gas-lift technology, the maximum pressure of gas-lift operation is 20.8 MPa, but after the application of this disclosure, the maximum pressure of gas-lift is only 13.58 MPa, so it can be explained that compared with the traditional gas-lift technology, the gas-lift pressure required by this disclosure is lower, and the pressure required for well start-up is lower.
3. As can be seen from FIG. 10, the pressure of the casing 32 suddenly drops after gas lift induced injection for the first time, and the pressure of the casing 32 is 5.9 MPa when the pump is stopped, resulting in insufficient pressure of the casing 32 during blowout. However, when the pressure reaches the maximum of 13.58 MPa, the casing pressure drops slowly, and the casing pressure is 13.05 MPa after gas lift is stopped, so it can be proved that the pressure drops slowly.

Figure 11:
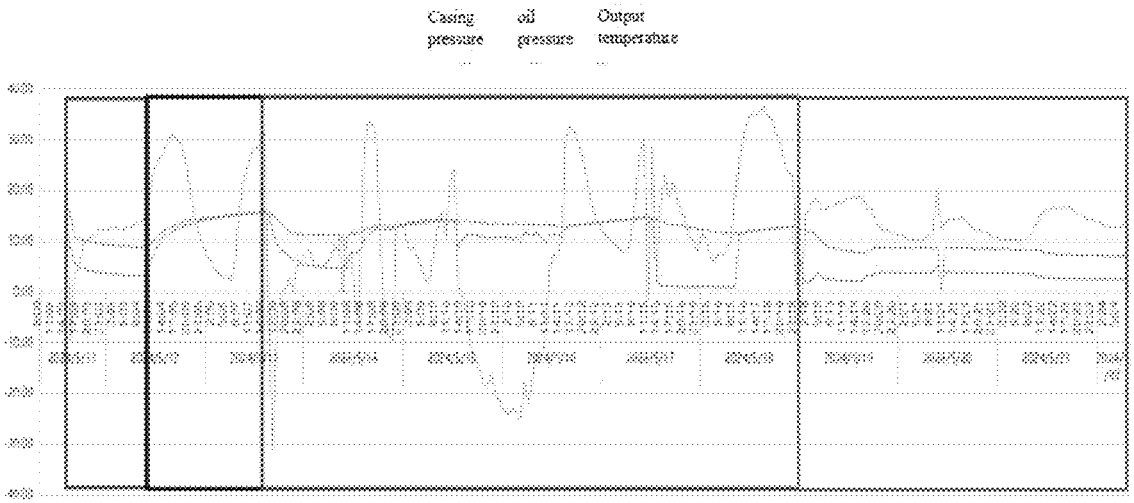
FIG. 11 shows the production situation 12 days after well handover according to an embodiment of the present application.

4. FIG. 11 shows the production situtation 12 days after well handover, which is divided into four stages from left to right: the first stage is the blue area, which is the first well opening for 20 hours after well handover, and the water content is relatively high from the production temperature. The second stage is the black area, and the production situation in this area is shut-in. The third stage is the read area, in which the production fluctuates greatly and the large strands of gas and liquid are discharged intermittently. It is judged that the killing fluid entering the bottom layer is being produced (After gas lift, the remaining fracturing fluid and killing fluid in the well total 201 $m^3$). The fourth stage is the green area. With the production of a large amount of liquid in the well, the production tends to be stable, and the stable production of gas-liquid mixture begins.

The present application has been described in detail above. The above is only the preferred embodiment of the present application. If the scope of implementation of the present application cannot be limited, that is, all the equal changes and modifications made according to the scope of this application should still fall within the scope of the present application.

What is claimed is:

1. A liquid accumulation-free production and drainage system for oil and gas well, comprising:

a casing, wherein the casing is arranged in the oil and gas well, and the bottom of the casing is inserted below the oil and gas liquid level; and a production string, wherein the production string is arranged in the casing, so that an annular gap is formed between the casing and the production string, wherein the production string comprises a plurality of oil and gas pipes, a plurality of anti-skid liquid accumulators and a plurality of anti-skid gas injectors one of the plurality of anti-skid liquid accumulators or one of the plurality of anti-skid gas injectors is arranged at every intervals of several of the plurality of oil and gas pipes, and in the lower part of the production string, the number of the plurality of anti-skid liquid accumulators between adjacent anti-skid gas injectors is smaller;

one of the plurality of anti-skid gas injectors comprises an oil and gas pipe joint and an anti-skid degassing hole structure on the oil and gas pipe joint;

the anti-skid degassing hole structure comprises an air supply channel arranged on the production string and used for communicating the inside and the outside of the production string, and a jet hole rotary block arranged in the air supply channel, wherein the center of the jet hole rotary block is provided with a jet hole A, and the jet hole A comprises a short conical hole, a fine hole and a long conical hole sequentially arranged and communicated according to a gas flow direction, and a taper of the short conical hole is greater than a taper of the long conical hole; and one of the plurality of anti-skid liquid accumulators comprises a pipe body, a main gas channel arranged in the center of the pipe body, an annular groove arranged on an inner wall of the pipe body and communicated with the main gas channel, a gas branch channel arranged in the annular groove and an annular liquid receiving groove with an upward opening, wherein the gas branch channel passes through the annular liquid receiving groove, a top wall of the annular groove is provided with an annular deflector, an inner wall of the annular deflector is smoothly connected with an inner wall of the upper part of the pipe body, and a lower part of the annular deflector is inserted into the annular liquid receiving groove, to form a bending passage in the annular liquid receiving groove, and an annular cylinder is arranged on the inner wall of the pipe body, and the annular cylinder and the inner wall of the pipe body form an annular cavity, the main gas channel is arranged in the center of the annular cylinder, the annular liquid receiving groove is arranged on the annular cylinder, and the annular cylinder is provided with a plurality of gas inlets communicating the main gas channel with the annular cavity, the annular cylinder is connected with the top wall of the annular groove in a gap, to form a first channel communicating with the annular cavity and the bending passage and an annular gas outlet communicating with the bending passage and the main gas channel.

2. The liquid accumulation-free production and drainage system of claim 1, wherein a limit boss is arranged in the air supply channel, and a steel pad and an annular gasket are arranged between the limit boss and the jet hole rotary block; and the air supply channel is obliquely arranged in a vertical direction, and a distance between an upper end of the air supply channel and the central axis of the production string is smaller than a distance between a bottom end of the air supply channel and the central axis of the production string.

3. The liquid accumulation-free production and drainage system of claim 1, wherein the air supply channel is eccentrically arranged with the central axis of the production string as the center in the horizontal direction.

4. The liquid accumulation-free production and drainage system of claim 1, wherein the annular cylinder comprises an annular base arranged on the inner wall of the pipe body, and the annular liquid receiving groove is arranged on the annular base;

the plurality of gas inlets are arranged on the annular base, and the position of the plurality of air inlets are higher than the lowest point of the annular cavity; and the annular liquid receiving groove is formed by enclosing an inner ring plate and an outer ring plate, and an upper surface of the inner ring plate is lower than an upper surface of the outer ring plate.

5. The liquid accumulation-free production and drainage system of claim 1, wherein the oil and gas pipe joint comprises a joint pipe body, a central gas channel arranged on the joint pipe body, a external thread and an internal thread respectively arranged at two ends of the joint pipe body; and the anti-skid degassing hole structure is arranged on the joint pipe body, and two ends of the air supply channel of the anti-skid degassing hole structure are respectively communicated with the annular gap and the central gas channel.

6. The liquid accumulation-free production and drainage system of claim 1, wherein a bottom of the casing is provided with a perforation section communicating with an oil-gas layer and an inside of the casing, and a bottom of the production string is provided with a sieve tube, a part of the production pipe string extends out of the ground is provided with a Christmas tree, and the annular gap is provided with an air charging port, and the air charging port is communicated with a high-pressure air source through an air injection pipeline.

* * * * *